US009534449B2

(12) United States Patent
Ringgenberg

(10) Patent No.: US 9,534,449 B2
(45) Date of Patent: Jan. 3, 2017

(54) HYDRAULIC CONTROL OF DRILL STRING TOOLS

(71) Applicant: Halliburton Energy Services, Inc., Houston, TX (US)

(72) Inventor: Paul Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/431,197

(22) PCT Filed: Oct. 22, 2013

(86) PCT No.: PCT/US2013/066116

§ 371 (c)(1),
(2) Date: Mar. 25, 2015

(87) PCT Pub. No.: WO2015/060825

PCT Pub. Date: Apr. 30, 2015

(65) Prior Publication Data

US 2016/0024850 A1 Jan. 28, 2016

(51) Int. Cl.

| | |
|---|---|
| ***E21B 10/32*** | (2006.01) |
| ***E21B 23/00*** | (2006.01) |
| ***E21B 23/04*** | (2006.01) |

(52) U.S. Cl.

CPC ..... *E21B 10/322* (2013.01); *E21B 23/006* (2013.01); *E21B 23/04* (2013.01)

(58) Field of Classification Search

None

See application file for complete search history.

(56) References Cited

U.S. PATENT DOCUMENTS

| | | | |
|---|---|---|---|
| 5,310,012 | A | 5/1994 | Cendre et al. |
| 5,890,542 | A | 4/1999 | Ringgenberg |
| 2006/0207797 | A1 | 9/2006 | Dewey et al. |

(Continued)

FOREIGN PATENT DOCUMENTS

| | | | |
|---|---|---|---|
| CN | 105556057 | A | 5/2016 |
| WO | WO-0058886 | A1 | 10/2000 |

(Continued)

OTHER PUBLICATIONS

"International Application Serial No. PCT/US2013/066116, International Search Report mailed Jul. 11, 2014", 4 pgs.

(Continued)

*Primary Examiner* — Jennifer H Gay
*Assistant Examiner* — Caroline Butcher
(74) *Attorney, Agent, or Firm* — Schwegman Lundberg & Woessner, P.A.; Alan Bryson

(57) ABSTRACT

A drill string tool has a control mechanism to switch the tool between an inactive condition and an active condition in response to operator-performance of a predefined trigger sequence comprising variations in a drilling fluid pressure differential. The trigger sequence comprises multiple cycles of (a) raising the predefined trigger sequence into, but not above, a predefined pressure range, and (b) lowering the predefined trigger sequence below a lower threshold of the pressure range. Raising of the pressure difference above an upper pressure range threshold results in automatic interruption and resetting of the predefined trigger sequence.

17 Claims, 7 Drawing Sheets

(56) References Cited

U.S. PATENT DOCUMENTS

| | | | | |
|---|---|---|---|---|
| 2009/0032308 | A1 | 2/2009 | Eddison et al. | |
| 2011/0073330 | A1 | 3/2011 | Radford | |
| 2013/0105172 | A1* | 5/2013 | Swenson | E21B 23/006 166/370 |
| 2014/0318806 | A1* | 10/2014 | Machocki | E21B 23/006 166/373 |

FOREIGN PATENT DOCUMENTS

| | | | |
|---|---|---|---|
| WO | WO-2013079929 | A2 | 6/2013 |
| WO | WO-2015060825 | A1 | 4/2015 |

OTHER PUBLICATIONS

"International Application Serial No. PCT/US2013/066116, Written Opinion mailed Jul. 11, 2014", 6 pgs.
"Austrailian Application Serial No. 2013403388, First Examiner Report mailed May 19, 2016", 3 pgs.
"International Application Serial No. PCT/US2013/066116, International Preliminary Report on Patentability mailed May 6, 2016", 8 pgs.

* cited by examiner

HYDRAULIC CONTROL OF DRILL STRING TOOLS

PRIORITY APPLICATIONS

This application is a U.S. National Stage Filing under 35 U.S.C. 371 from International Application No. PCT/US2013/066116, filed on 22 Oct. 2013, which application is incorporated herein by reference in its entirety.

TECHNICAL FIELD

The present application relates generally to drill string tools in drilling operations, and to methods of operating drill string tools. Some embodiments relate more particularly to fluid-activated control systems, apparatuses, mechanisms and methods for controlling operation of drill string tools. The disclosure also relates to downhole reamer deployment control by pressure-sequencing of drilling fluid conveyed by a drill string.

BACKGROUND

Boreholes are commonly drilled into the ground to recover hydrocarbons, such as oil and gas, from subterranean formations. Such boreholes are usually drilled with a drill bit at the end of a drill string. The drill string can be formed on-site by consecutively adding any number of tubular members (sometimes also referred to as segments of drill pipe). The lower end of the drill string commonly includes a bottomhole assembly, having any number of drill string tools, with the drill bit attached to the bottom end. The drill bit is rotated, such as by rotating the drill string or by independently rotating the drill bit using a mud motor, to shear or disintegrate material of the rock formation to drill the wellbore.

Some tools and devices included in a drill string require remote activation and deactivation during drilling operations. Examples of such tools and devices include reamers, stabilizers, and force application members used for steering the drill bit. The harsh downhole environment, however, routinely poses a challenge for designers of electro-mechanical control systems, to achieve a desired level of performance and reliability.

Various methods have been devised for remotely operating tools using controlled fluid pressure. The use of controlled fluid pressure in the drill string often allows a limited number of activation/deactivation cycles, after which the control system is to be reset. Some reamer activation apparatuses, for example, use a ball-drop mechanism that permits a single activation cycle, after which a reset of the control system is required. In many conventional systems, the drilling fluid (i.e. "mud") cycled down the drill string and back up a borehole annulus can be used as the control fluid. In such systems, the drilling mud can perform multiple separate functions, with corresponding drilling fluid pressure levels. In addition to pressurization of the drilling mud to circulate it through the drill string and the annulus, drilling mud pressure and flow can, for example, be varied to control mud motor speed and/or torque. Because of such multiple, distinct reasons for variations in drilling mud pressure during drilling operations, using drilling mud to control a tool or device actuation mechanism can cause inadvertent tool activation resulting from misinterpretation of unrelated mud pressure fluctuations as actuating mechanism control signals.

BRIEF DESCRIPTION OF THE DRAWINGS

Some embodiments are illustrated by way of example and not limitation in the figures of the accompanying drawings in which.

DETAILED DESCRIPTION

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

According to one aspect of the disclosure, a drill string is provided with a control mechanism which is configured to enable remote hydraulic switching of a drill string tool between different operational modes (e.g., deployment and/or retraction of a reamer) by varying a pressure difference between the drill string bore and the surrounding annulus (i.e., a bore-annulus pressure difference) to perform a predefined trigger sequence comprises multiple cycles of raising the pressure difference to within one or more respective pressure ranges. The control mechanism may be configured to automatically reset or interrupt the trigger sequence if the pressure difference rises above a predefined threshold of a corresponding pressure range. The control mechanism may further be configured to permit performance of repeated activation/deactivation cycles while the tool remains downhole.

The control mechanism may a passive mechanical system, being configured such that functional operation of the control mechanism responsive to pressure difference variations is substantially exclusively mechanical, comprising, e.g., one or more hydraulic actuating mechanisms, spring biasing mechanisms, and cam mechanisms). In such a case, at least those parts of the control mechanism that provide the disclosed functionalities may operate without contribution from any substantially non-mechanical components (e.g., electrical components, electromechanical components, or electronic components).

Figure 1:
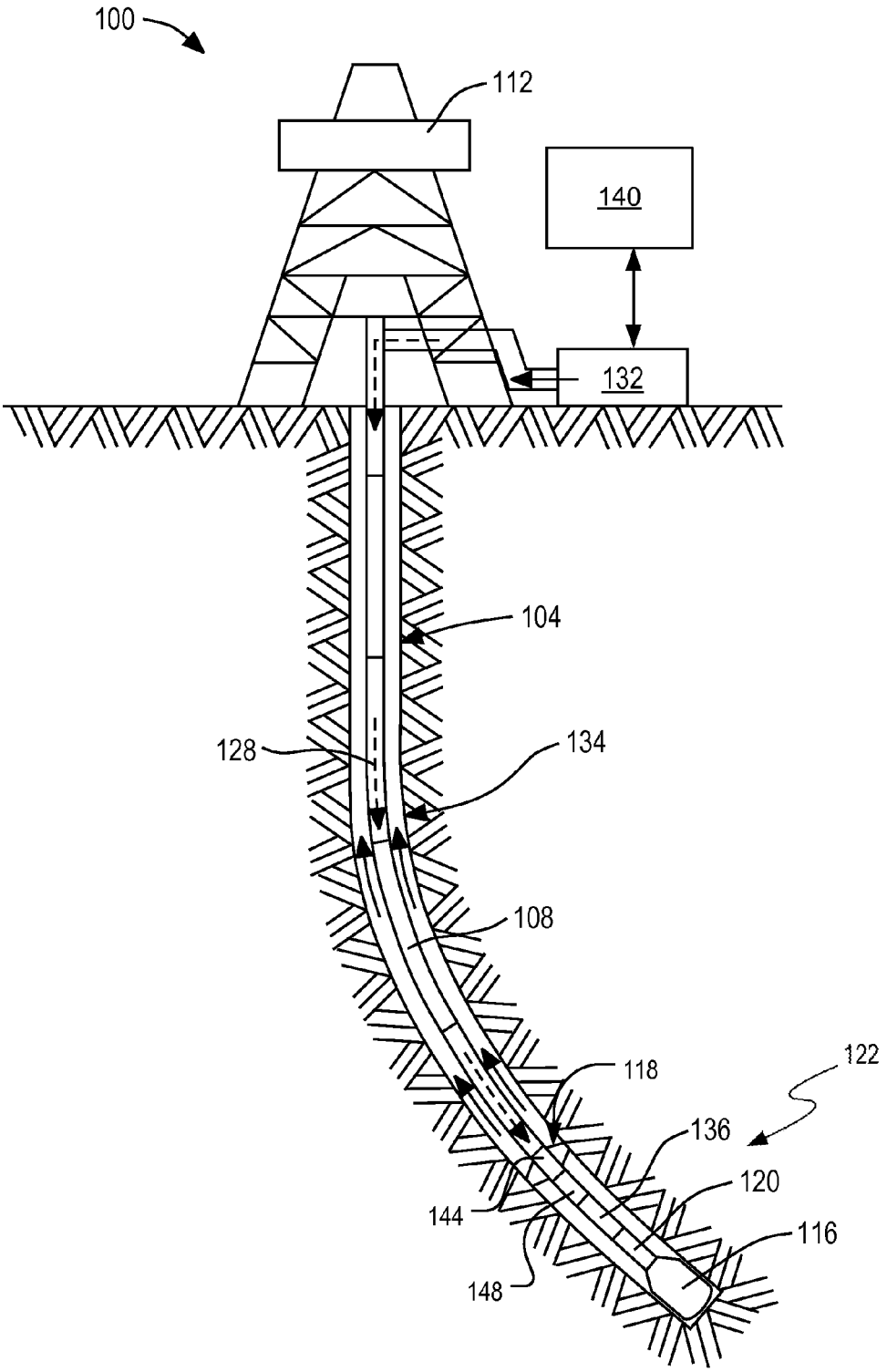
FIG. 1 depicts a schematic diagram of a drilling installation including a drilling apparatus that provides a control arrangement for hydraulic control of tool activation by predefined drilling fluid pressure sequencing in, in accordance with an example embodiment.

FIG. 1 is a schematic view of an example embodiment of a system to control activation and deactivation of a drill string tool by applying a predefined sequence of fluid pressures variations to a drilling fluid (e.g., drilling mud).

A drilling installation 100 includes a subterranean borehole 104 in which a drill string 108 is located. The drill string 108 may comprise jointed sections of drill pipe suspended from a drilling platform 112 secured at a wellhead. A downhole assembly or bottom hole assembly (BHA) 122 at a bottom end of the drill string 108 may include a drill bit 116 to disintegrate earth formations at a leading end of the drill string 108, to pilot the borehole 104, and one or more reamer assemblies 118, uphole of the drill bit 116 to widen the borehole 104 by operation of selectively deployable cutting elements.

The borehole 104 is thus an elongated cavity that is substantially cylindrical, having a substantially circular cross-sectional outline that remains more or less constant along the length of the borehole 104. The borehole 104 may in some cases be rectilinear, but may often include one or more curves, bends, doglegs, or angles along its length. As used with reference to the borehole 104 and components therein, the "axis" of the borehole 104 (and therefore of the drill string 108 or part thereof) means the longitudinally extending centerline of the cylindrical borehole 104. "Axial" thus means a direction along a line substantially parallel with the lengthwise direction of the borehole 104 at the relevant point or portion of the borehole 104 under discussion; "radial" means a direction substantially along a line that intersects the borehole axis and lies in a plane perpendicular to the borehole axis; "tangential" means a direction substantially along a line that does not intersect the borehole axis and that lies in a plane perpendicular to the borehole axis; and "circumferential" or "rotational" means a substantially arcuate or circular path described by rotation of a tangential vector about the borehole axis.

"Rotation" and its derivatives mean not only continuous or repeated rotation through 360° or more, but also includes angular displacement of the less than 360°.

As used herein, movement or location "forwards" or "downhole" (and related terms) means axial movement or relative axial location towards the drill bit 116, away from the surface. Conversely, "backwards," "rearwards," or "uphole" means movement or relative location axially along the borehole 104, away from the drill bit 116 and towards the earth's surface. Note that in FIGS. 2, 3, 4, and 6 of the drawings, the downhole direction of the drill string 108 extends from left to right.

A measurement and control assembly 120 may be included in the BHA 122, which also includes measurement instruments to measure borehole parameters, drilling performance, and the like.

Drilling fluid (e.g. drilling "mud," or other fluids that may be in the well), is circulated from a drilling fluid reservoir, for example a storage pit, at the earth's surface, and coupled to the wellhead by a pump system 132 that forces the drilling fluid down a drilling bore 128 provided by a hollow interior of the drill string 108, so that the drilling fluid exits under relatively high pressure through the drill bit 116. After exiting from the drill string 108, the drilling fluid moves back upwards along the borehole 104, occupying a borehole annulus 134 defined between the drill string 108 and a wall of the borehole 104. Although many other annular spaces may be associated with the drilling installation 100, references to annular pressure, annular clearance, and the like, refer to features of the borehole annulus 134, unless otherwise specified or unless the context clearly indicates otherwise.

Note that the drilling fluid is pumped along the inner diameter (i.e., the bore 128) of the drill string 108, with fluid flow out of the bore 128 being restricted at the drill bit 116. The drilling fluid then flows upwards along the annulus 134, carrying cuttings from the bottom of the borehole 104 to the wellhead, where the cuttings are removed and the drilling fluid may be returned to the drilling fluid reservoir 132. Fluid pressure in the bore 128 is therefore greater than fluid pressure in the annulus 134. Unless the context indicates otherwise, the term "pressure differential" means the difference between general fluid pressure in the bore 128 and pressure in the annulus 134.

In some instances, the drill bit 116 is rotated by rotation of the drill string 108 from the platform 112. In this example embodiment, a downhole motor 136 (such as, for example, a so-called mud motor or turbine motor) disposed in the drill string 108 and, this instance, forming part of the BHA 122, may contribute to rotation of the drill bit 116. In some embodiments, the rotation of the drill string 108 may be selectively powered by surface equipment, by the downhole motor 136, or by both the surface equipment and the downhole motor 136.

The drilling installation 100 may include a surface control system 140 to receive signals from downhole sensors and devices telemetry equipment, the sensors and telemetry equipment being incorporated in the drill string 108, e.g. forming part of the BHA 122. The surface control system 140 may display drilling parameters and other information on a display or monitor that is used by an operator to control the drilling operations. Some drilling installations may be partly or fully automated, so that drilling control operations (e.g., control of operating parameters of the motor 136 and control of drill string tool deployment through pressure sequencing of the drilling fluid, as described herein) may be either manual, semi-automatic, or fully automated. The surface control system 140 may comprise a computer system having one or more data processors and data memories. The surface control system 140 may process data relating to the drilling operations, data from sensors and devices at the surface, data received from downhole, and may control one or more operations of drill string tools and devices that are downhole and/or surface devices.

The drill string 108 may include one or more drill string tools instead of or in addition the reamer assembly 118. The drill string tools of the drill string 108, in this example, thus includes at least one reamer assembly 118 located in the BHA 122 to enlarge the diameter of the borehole 104 as the BHA 122 penetrates the formation. In other embodiments, the drill string 108 may comprise multiple reamer assemblies 118, for example being located adjacent opposite ends of the BHA 122 and being coupled to the BHA 122.

Figure 2:
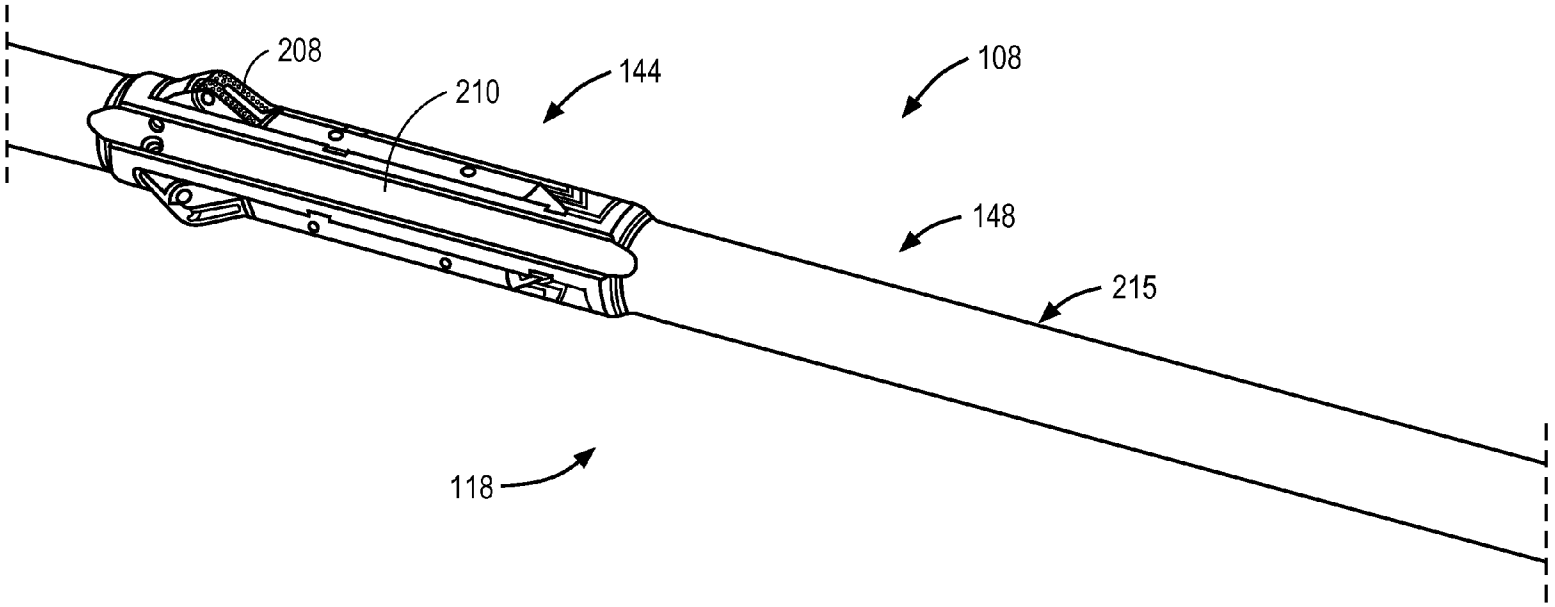
FIG. 2 depicts a three-dimensional view of a drilling apparatus for drilling fluid-activated control of reamer activation, in accordance with an example embodiment.

Each reamer assembly 118 may comprise one or more circumferentially spaced blades or other cutting elements that carry cutting structures (see, e.g., cutting arms 208 in FIG. 2). The reamer assembly 118 includes a reamer 144 comprising a body in the example form of a generally tubular housing incorporated in-line in the drill string 108 and carrying cutting elements of that are radially extendable and retractable from a radially outer surface of the reamer housing, to selectively expand and contract the reamer's effective diameter.

Controlled selection of an operational mode of the reamer 144 (e.g., deployed or retracted) may be effected by controlling drilling fluid pressure. In this example, deployment control mechanisms that are configured to trigger deployment or retraction of the reamer cutting elements responsive exclusively to specific variations or sequences of drilling fluid pressure values are provided by a controller 148 that forms part of the reamer assembly 118. The controller 148 may comprise an apparatus having a body in the example form of a generally tubular drill pipe housing 215 (see FIG. 2) connected in-line in the drill string 108. In the example embodiment of FIG. 1, the controller 148 is mounted downhole of the tool reamer 144, but in other embodiments (e.g. the example embodiment illustrated in FIG. 4), the controller 148 may be positioned uphole of the reamer 144.

Although fluid-pressure control of tool deployment (example mechanisms of which will be discussed presently) provides a number of benefits compared, e.g., to electromechanical deployment mechanisms, such fluid-pressure control may introduce difficulties in performing drilling operations. There is seldom, for example, a simple direct correspondence between fluid pressure values and desired reamer deployment. Although reaming operations in this example coincide with high fluid pressure in the bore 128 (also referred to as bore pressure or internal pressure), the reamer 144 is not to be deployed with every occurrence of high bore pressure. The bore pressure may, for example be ramped up to drive the drill bit 116 via the motor 136 when the borehole 104 is being drilled. Reamer deployment during such a drilling phase is seldom desirable.

The example controller 148 ameliorates this difficulty by permitting deployment of the reamer 144 responsive to high drilling-fluid pressure only subsequent to a specific, predefined trigger sequence of bore pressure values or bore-annulus pressure differentials.

FIG. 2 shows an example embodiment of a reamer assembly 118 that may form part of the drill string 108, with the reamer 144 that forms part of the reamer assembly 118 being in an extended mode. In the extended or deployed mode, reamer cutting elements in the example form of reamer arms 208 are radially extended, standing proud of the reamer housing 210 and projecting radially outwards from the reamer housing 210 to make contact with the borehole wall for reaming of the borehole 104 when the reamer housing 210 rotates with the drill string 108.

In this example, the reamer arms 208 are mounted on the reamer housing 210 in axially aligned, hingedly connected pairs that jackknife into deployment, when actuated. When, in contrast, of the reamer 144 is in a retracted mode, the reamer arms 208 are retracted into the tubular reamer housing 210. In the retracted mode, the reamer arms 208 do not project beyond the radially outer surface of the reamer housing 210, therefore clearing the annulus 134 and allowing axial and rotational displacement of the reamer housing 210 as part of the drill string 108, without engagement of a borehole wall by the reamer arms 208.

Figure 3A:
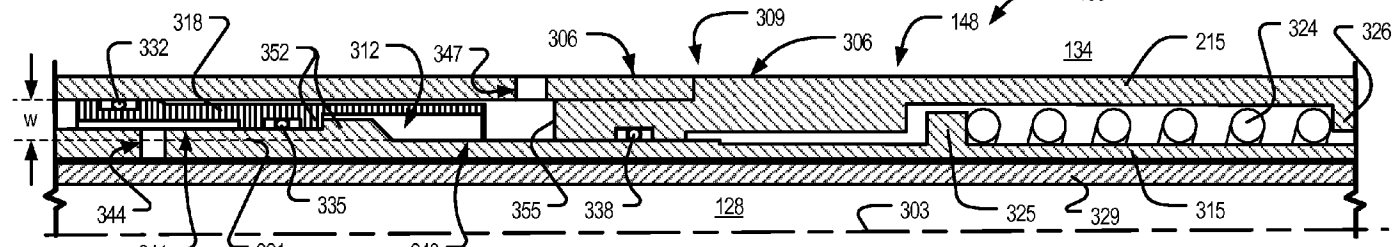
FIGS. 3A-3C depict partial longitudinal sections of a part of a drill string tool control apparatus forming part of a drill string in accordance with an example embodiment, the apparatus comprising a staged piston mechanism shown in various stages of deployment in FIGS. 3A-3C respectively.
Figure 3B:
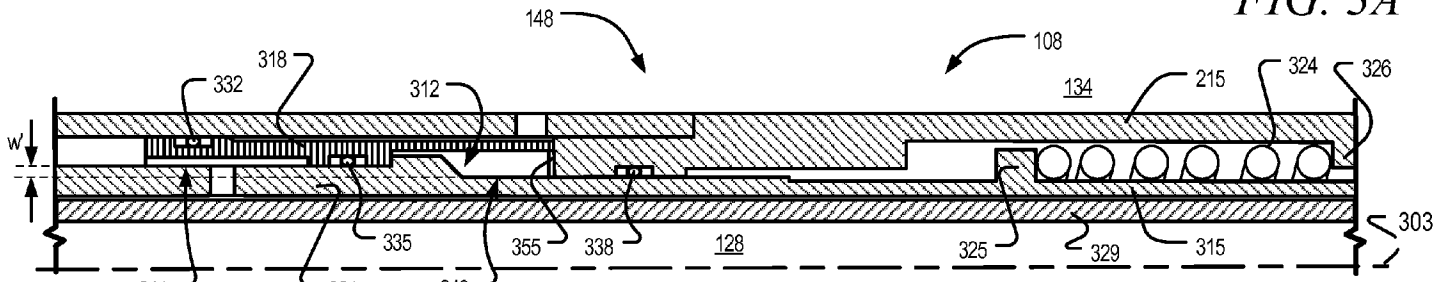
Figure 3C:
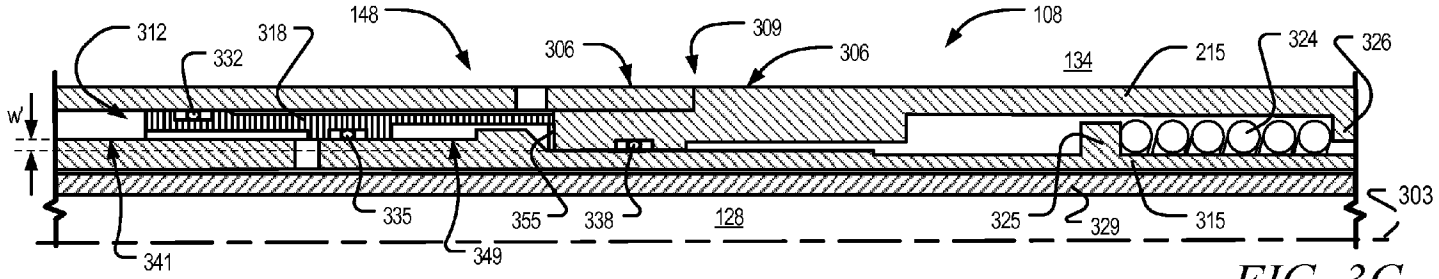

FIGS. 3A-3C schematically illustrate an example embodiment of a controller 148 to form part of the drill string 108, being operatively connected to the reamer 144 in the reamer assembly 118. The controller 148 comprises a control mechanism to facilitate selective control of reamer deployment or activation responsive to predefined trigger variations of fluid pressure differences between the bore 128 and the annulus 134. Note that FIGS. 3A-3C show only half of the tubular components comprising the controller 148, these tubular components being generally symmetrical about the longitudinal axis 303 of the controller 148 (which is co-axial with the longitudinal axis of the drill string 108).

The controller 148 has a body in the example form of a generally tubular controller housing 215 that may comprise co-axially connected drill pipe sections 306 that are in-line with and form part of the tubular body of the drill string 108. In this example, the drill pipe sections 306 are connected together by screw threaded engagement of complementary connection formations at adjacent ends of the respective drill pipe sections 306, to form a screw threaded joint 309.

A staged hydraulic actuation mechanism may be provided by the controller 148, in this example comprising a piston assembly that provides a multistage composite piston 312 which is co-axially slidable within a hollow interior of the controller housing 215. A mandrel 315 is operatively connected to the composite piston 312 and is longitudinally slidable relative to the controller housing 215 to cause hydraulically actuated tool activation (as described in greater detail below with reference to FIG. 4) responsive to staged or stepwise hydraulic actuation of the composite piston 312.

The composite piston 312 may comprise a first-stage piston 318 and a second-stage piston 321 that are operatively connected to the mandrel 315 to displace the mandrel 315 axially against an biasing mechanism in the example form of a compression spring 324 acting between the mandrel 315 and the housing 215. The schematic view of FIGS. 3A-3C shows the compression spring 324 being axially held captive between an annular rib 325 on the mandrel 315 and a spring shoulder 236 provided by the controller housing 215 and projecting radially inwards towards the mandrel 315.

In this example embodiment, the second-stage piston 321 is axially anchored to the mandrel (e.g., being of monolithic tubular construction), so that the second stage piston and the mandrel 315 are connected together for bi-directional axial displacement. The first-stage piston 318, however, is axially displaceable relative both to the controller housing 215 and the second-stage piston 321. The second-stage piston 321 is co-axially slidable within the first-stage piston 318, telescope-fashion.

In this example embodiment, the controller 148 includes an inner pipe 329 that is co-axially aligned with the controller housing 215 and has an outer diameter smaller than an inner diameter of the second-stage piston 321. The inner pipe 329 is thus located co-axially within the second-stage piston 321, the second-stage piston 321 being axially slidable relative to the inner pipe 329.

The controller 148 includes a number of sealing members that provide sealing, slidable contact between the first-stage piston 318 and the controller housing 215, between the first-stage piston 318 and the second-stage piston 321, and between the second-stage piston 321 and the controller housing 215.

The first-stage piston 318 is in sealing engagement with the controller housing 215, in this example embodiment having an outer seal 332 (e.g., in the form of a resilient O-ring seal) housed in a cavity in a radially outer surface of the first-stage piston 318, to provide sealing, slidable contact between the first-stage piston 318 and the radially inner cylindrical surface of the controller housing 215. The first-stage piston 318 likewise has a radially inner seal 335 (e.g., in the form of a resilient O-ring seal) housed in a recess in a radially inner surface of the first-stage piston 318, to provide sealing, slidable contact between the first-stage piston 318 and the second-stage piston 321.

Sealed, slidable engagement of the second-stage piston 321 with the controller housing 215 provided by a radially innermost seal 338 (e.g., in the form of a resilient O-ring seal) housed in a recess in the controller housing 215 and bearing against a radially outer surface of the second-stage piston 321. As can be seen in FIG. 3, the innermost seal 338 is radially located closest to the longitudinal axis 303 of the controller 148, with the inner seal 335 having a radial spacing from the axis 303 greater than that of the innermost seal 338. The outer seal 332 has a yet greater radial spacing from the axis 303, being radially spaced furthest from the axis 303.

In this example embodiment, the controller 148 thus defines a number of a generally annular fluid-pressure chambers located radially between the radially inner surface of the controller housing 215 and the second-stage piston 321 (and/or the mandrel 315). A bore-pressure chamber 341 is defined immediately uphole of the first-stage piston 318, being bounded by the outer seal 332 and the inner seal 335. The bore-pressure chamber 341 is in fluid flow communication with the bore 128 and is therefore, in operation, filled with fluid at bore pressure. As shown schematically in FIG. 3A a fluid passage 344 may, for example, extend radially through the second-stage piston 321. Note that the inner pipe 329 may, at least in some places, permeable, thereby permitting mud flow from the bore 128 through the fluid passage 344 to the bore-pressure chamber 341.

An annulus-pressure chamber 349 is defined downhole of the outer seal 332 and the inner seal 335, being bounded at its downhole end by the innermost seal 338. The annulus-pressure chamber 349 is exposed to annulus pressure via a fluid passage 347 extending radially through the controller housing 215, so that the annulus-pressure chamber 349 is, during operation, filled with drilling mud at annulus pressure.

The first-stage piston 318 and the second-stage piston 321 have complementary cooperating shoulders 352 arranged such that the second-stage piston 321 is anchored to the first-stage piston 318 for axial displacement therewith in the downhole direction (i.e., leftward movement when the controller 148 is oriented as shown in FIG. 3A) when the shoulders 352 are in contact, while allowing independent downhole axial displacement of the second-stage piston 321 relative to the first-stage piston 318. A bias force exerted by the compression spring 324 on the mandrel 315, and by extension on the second-stage piston 321, is transferred to the first-stage piston 318 via the shoulders 352, when they are in abutment. The composite piston 312 is thus urged axially upwards by the compression spring 324, while a resultant hydraulic actuating force exerted on the composite piston 312 due to a pressure differential between fluid pressures in the bore 128 (mirrored by the bore-pressure chamber 341) and the annulus 134 (mirrored by the annulus-pressure chamber 349) tends to urge the composite staged piston 312 downhole, bore pressure typically being higher than the annulus pressure.

The controller housing 215 provides a stop shoulder 355 to stop axial downhole movement of the first-stage piston 318 at a particular position by abutment of a downhole end of the first-stage piston 318 against the stop shoulder 355 (see FIG. 3B). The second-stage piston 321 is axially displaceable downhole beyond its position corresponding to the extreme downhole position of the first-stage piston 318 (see, e.g., FIG. 3C), before fouling on the stop shoulder 355.

Note that hydraulic actuating forces exerted on the composite staged piston 312 or on the second-stage piston 321 are determined in part by differential areas of the respective generally pipe-shaped components from their radially inner periphery to their radially outer periphery, when viewed in cross-section. An initial annular operating area acting on the composite piston 312 (formed by the first-stage piston 318 and the second-stage piston 321 moving together) has a radial width defined between the inner diameter of the controller housing 215 (e.g., corresponding to outer seal 332) and the outer diameter of the mandrel 315 (corresponding to the innermost seal 338), as indicated by dimension w in FIG. 3A.

When, however, hydraulic actuation of the composite piston 312 in the downhole direction results in abutment of the first-stage piston 318 against the stop shoulder 355, the operative differential area in which the pressure differential is effective for the second-stage piston 321 is defined between the outer diameter of the second-stage piston 321 (corresponding to inner seal 335) and the outer diameter of the mandrel 315 (defined by innermost seal 338), as indicated by dimension w' in FIG. 3B.

Due to the difference in effective differential area for the composite piston 312 and the second-stage piston 321, a greater pressure differential is required to displace the second-stage piston 321 downhole, against the urging of the spring 324, than is needed for displacing the composite piston 312 downhole, to compress the spring 324. In this example embodiment, the parameters of the compression spring 324, and the dimensions of the controller housing 215, the mandrel 315, and the pistons 318, 321 are selected such that the composite piston 312 is hydraulically actuated against the compression spring 324 for pressures greater than about 250 psi, while the second-stage piston 321 is hydraulically actuated to move downhole in isolation against the compression spring 324 for pressures greater than about 750 psi.

Note that for an intermediate pressure range, in this example being 250-750 psi, the composite piston is substantially stationary, the pressure difference is being large enough push the first stage piston 318 to its extreme downhole position, but being too small to push the second stage piston 321 further downhole, on its own. The staged piston 312 therefore provides an intermediate position (shown in FIG. 3A) corresponding to the intermediate pressure range, in which the composite piston 312 is shouldered out, but in which no further downhole displacement of the mandrel 315 occurs.

Figure 4A:
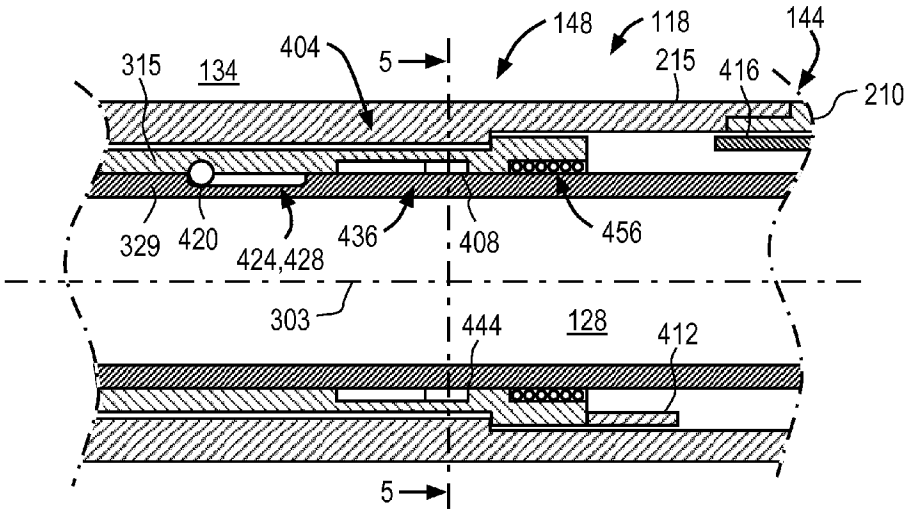
FIG. 4A-4C depict a longitudinal section of another part of the longitudinal section of a drill string tool control apparatus forming part of the drill string in accordance with an example embodiment, the example apparatus comprising a cam mechanism and an activation mechanism which are illustrated schematically in FIG. 4.
Figure 4B:
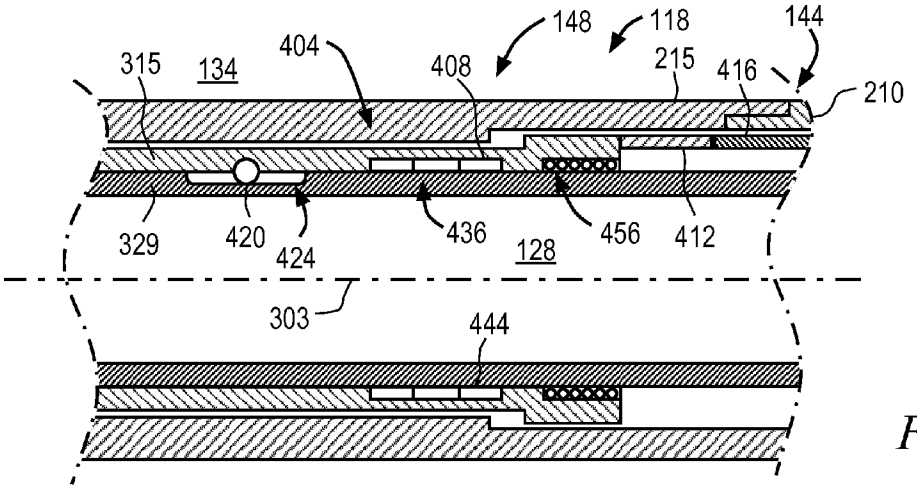
Figure 4C:
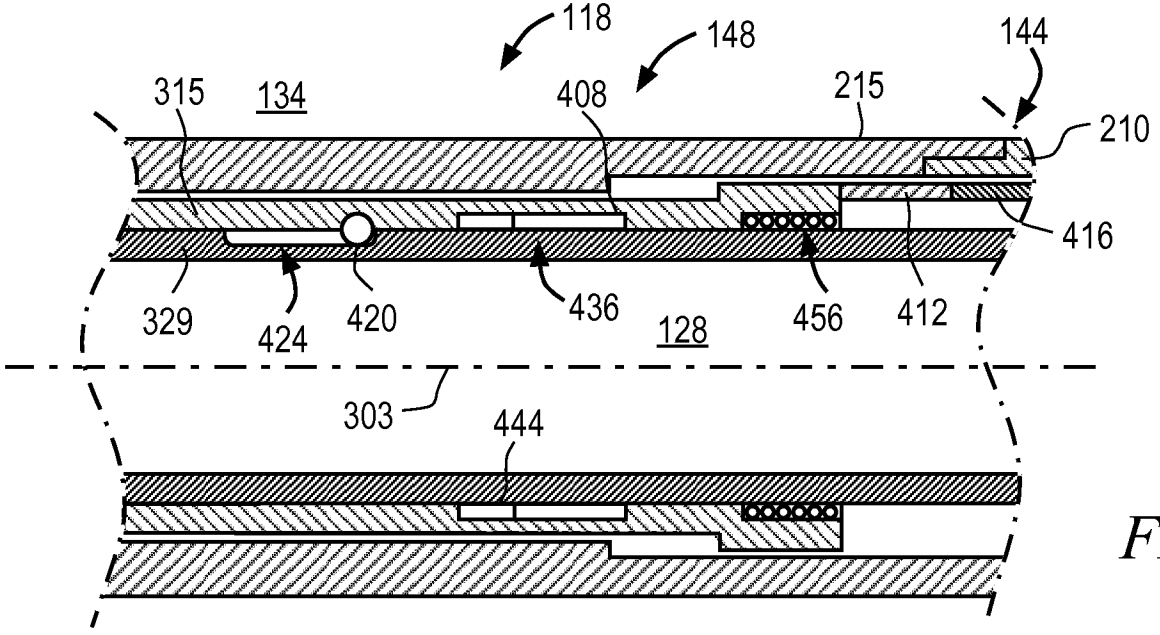

FIG. 4A shows a longitudinal section of a part of the controller 148 located downhole of the staged piston 312 discussed with reference to FIGS. 3A-3C, with the mandrel 315 that is actuated by the staged piston 312 extending co-axially along the generally tubular controller housing 215. The controller housing 215 is screw-threadedly connected, at its operatively downhole end, to a generally tubular housing 210 of the reamer 144 forming part of the reamer assembly 118. As mentioned previously, the reamer 144, is, in this example embodiment, located downhole of the controller 148, while, in other embodiments (see, e.g., FIG. 2) the reamer 144 may be located uphole of the controller 148. In such case, a tool activation mechanism as described further herein may be modified in position arrangement, to account for the different relative positions of the controller 148 and the reamer 144.

The controller 148 further comprises a carriage member 404 that comprises a generally tubular sleeve 408 that serves as a barrel cam. The sleeve 408 is co-axial with the controller housing 215, being located radially between the inner pipe 329 and the controller housing 215. The carriage member 404, in this example embodiment, serves as a carriage for a tool activation component in the example form of an actuating finger 412 that projects longitudinally from a lower end of the sleeve 408. To this end, the sleeve 408 is operatively connected to the mandrel 315 for axial displacement with the mandrel 315, while being rotationally displaceable relative to the inner pipe 329 and the controller housing 215.

A reamer activation mechanism (which, in this example embodiment, is carried on the reamer 144) includes a trigger component in the example form of a trigger finger 416 that projects axially uphole from the reamer 144. The activation mechanism is thus, in this example embodiment, configured to activate the reamer 144 (e.g., to extend the reamer arms 208) by end-to-end engagement of the actuating finger 412 with the trigger finger 416 and consequent displacement of the trigger finger 416 axially downhole under hydraulic actuation via the actuating finger 412.

As mentioned above, the sleeve 408 is mounted for rotational reciprocation and for axial reciprocation relative both to the inner pipe 329 and the controller housing 215. As shown in FIG. 4A, the actuating finger 412 and the trigger finger 416 are angularly misaligned, so that axial movement of the sleeve 408 downhole does not result in end-to-end contact between the fingers 412, 416. When the sleeve 408 is rotated about the inner pipe 329 by a predetermined angle (in this example 180°), the fingers 412, 416 are brought into alignment (FIG. 4B), in which case axial displacement of the sleeve 408 to a sufficient extent results in engagement of the trigger finger 416 by the actuating finger 412, to activate the reamer 144.

Rotation of the sleeve 408 is controlled by a cam mechanism acting between the sleeve 408 and the inner pipe 329, e.g. comprising engagement of a cam member carried by the sleeve 408 with a cam surface on the radially outer surface of the inner pipe 329. In this example embodiment, the cam member comprises a cam ball 420 held captive in a complimentary recess in the inner surface of the sleeve 408, the cam surface comprising a cam track 424 defined in the outer surface of the inner pipe 329. In this example embodiment comprises a number of slots 428, for example comprising a number of so-called J-slots, as will be described in further detail below. In this example embodiment, the cam track 424 is shaped to require a predefined sequence of pressure-differentials to bring the fingers 412, 416 into alignment, and to permit sufficient subsequent axial displacement of the sleeve 408 to push the trigger finger 416 into an activated position.

The sleeve 408 is rotationally biased by a rotational bias mechanism that, in this example embodiment, comprises a torsion spring 456 that acts between the inner pipe 329 and the sleeve 408, urging angular displacement of the sleeve 408 relative to the inner pipe 329 in a particular rotational direction. In this example embodiment, the torsion spring 456 urges displacement of the sleeve 408 in a clockwise direction, when the controller 148 is viewed in a downhole direction along its axis 303 (see FIG. 5).

Rotation of the sleeve 408 under the bias of the torsion spring 456 may be restricted by engagement of the cam ball 420 with one of the cam slots 428. Rotation of the sleeve 408 is thus permitted only if the cam ball 420 is in a portion of the cam track 424 that permits rotation of the sleeve 408 relative to the inner pipe 329.

The carriage member 404 further comprises an anti-reverse mechanism (e.g., a ratchet mechanism) to prevent rotation of the sleeve 408 under the urging of the torsion spring 456 when the ratchet mechanism is engaged, while allowing actuated rotational movement of the sleeve 408 (e.g., by operation of the cam mechanism) against the urging of the torsion spring 456.

Figure 5:
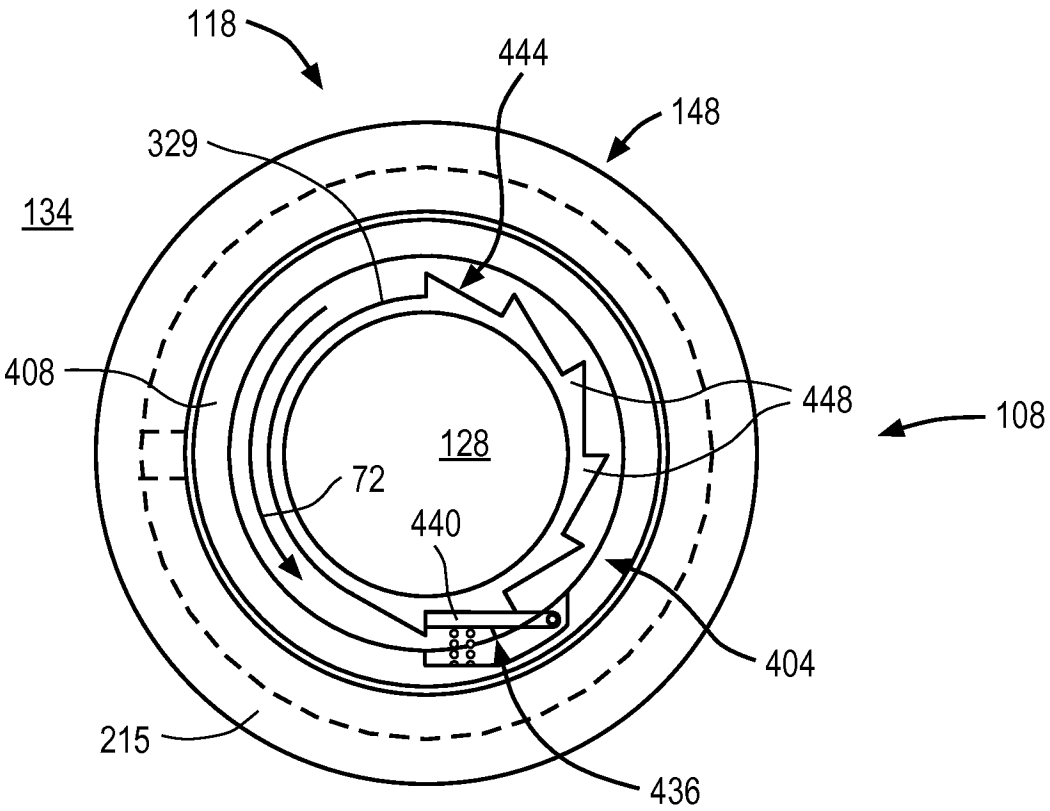
FIG. 5 depicts a transverse cross-section of a drill string tool control apparatus forming part of a drill string in accordance with an example embodiment, taken along line 5-5 in FIG. 4A.

FIG. 5 shows a cross-sectional view of the controller 148, taken along line 5-5 in FIG. 4A. As can be seen in FIG. 5, the inner pipe 329 in this example embodiment has a ratchet gear 444 that forms part of the anti-reverse mechanism, defining a set of ratchet teeth 448 extending circumferentially around at least a part of the inner pipe 329. A pawl 440 is carried in the sleeve 408, and is spring-loaded to be biased into engagement with at least one of the ratchet gear 444.

The teeth of the ratchet gear 444 are shaped so that rotational movement of the sleeve 408 about the inner pipe 329 is stopped by engagement of the pawl 440 with one of with the teeth, while allowing rotation of the sleeve 408 about the inner pipe 329 in the opposite rotational direction.

In this example, the actuating finger 412 rotates 180° from a fully reset position or default position (FIG. 3A), to a primed position (FIG. 3B), and the ratchet teeth 448 therefore extend at least 180° about the inner pipe 329. In other embodiments, however, different amounts of rotation may be employed, if desired.

Figure 6:
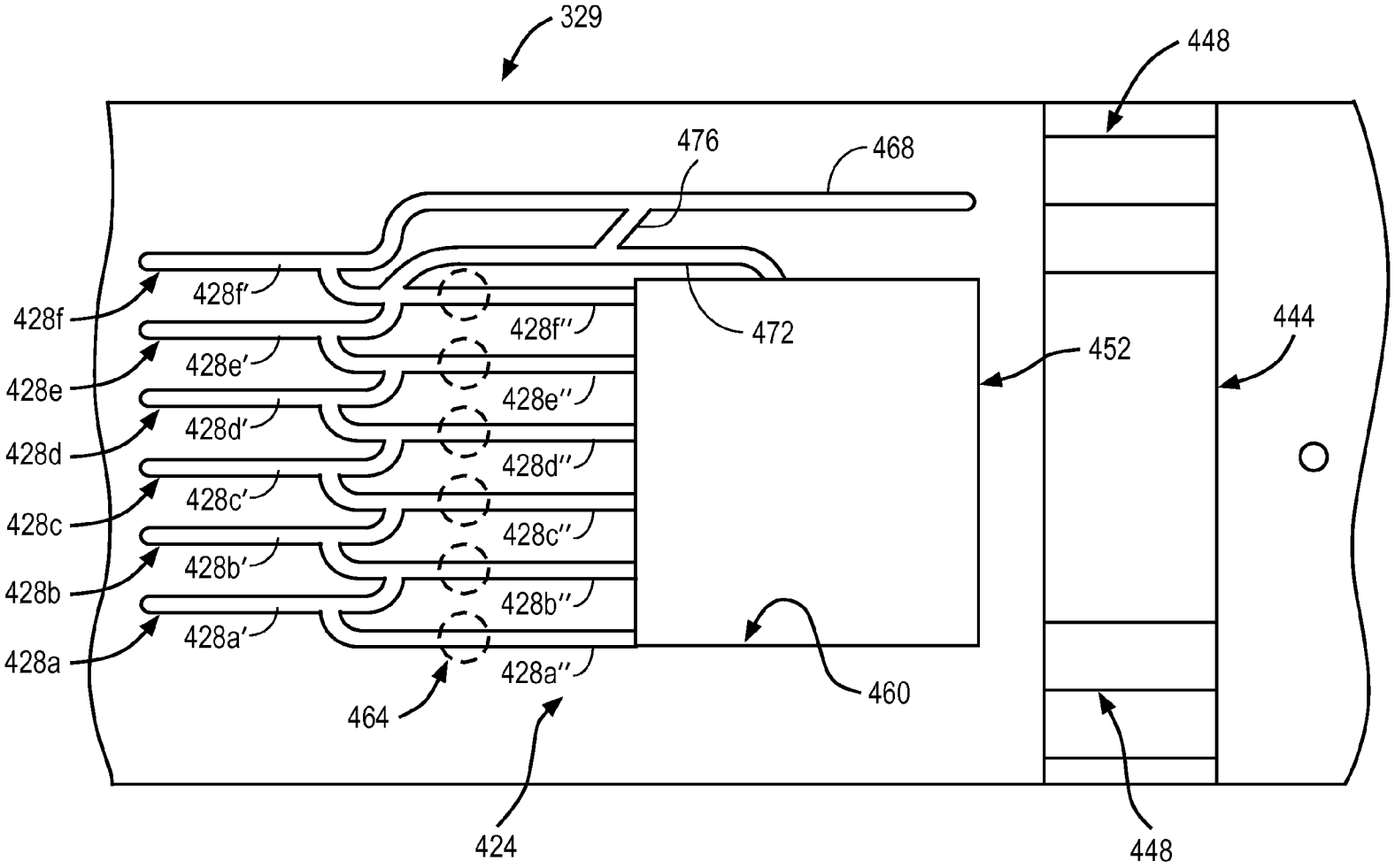
FIG. 6 depicts a schematic flattened or unrolled view of a radially outer surface of an inner pipe that forms part of the apparatus in accordance with an example embodiment, and provides a cam recess in which a cam member on a carriage member is receivable to translate longitudinal displacement of the carriage member to rotational movement thereof.

The shape and configuration of the cam track 424 in this example embodiment is schematically shown in FIG. 6, in which an "unrolled" or "flattened" view of the radially outer surface of the inner pipe 329 is shown. The cam track 424 of this example embodiment comprises a series of axially extending, circumferentially spaced J-slots that are arranged in oppositely oriented pairs. Each pair of slots 428 comprises a low-pressure slot 428' and an oppositely oriented intermediate slot 428". Note that the slots 428 of each pair are oppositely oriented the axial direction, but that hooks or curved ends of the respective J-slots 428 curve in the same rotational direction.

A rectilinear portion of each J-slot 428 is oriented axially, with a curved portion of the respective low-pressure slots 428' being located at a downhole end of the rectilinear portion. In contrast, the curved portion of each intermediate slot 428" is located at an uphole end of the corresponding rectilinear slot portion. The curved portion of each intermediate slot 428" joins the rectilinear portion of the corresponding low-pressure slot 428', adjacent its curved portion. The curved portion of each low-pressure slot 428' (except for a terminal low-pressure slot **428*f*), in turn, joins the rectilinear portion of a successive intermediate slot 428" adjacent its curved portion. The series of slots 428 are therefore interconnected to form a continuous path along which the cam ball 420** is movable.

In this example embodiment, each pair of slots 428 serves to rotate the sleeve 408 through 30°, thereby rotating the sleeve 408 by 180° in total. As mentioned previously, other embodiments may employ a different number and/or arrangement of slots, and may be configured to rotate the sleeve 408 through a smaller or a greater angle.

Axial displacement of the cam ball 420 along the curved portions of the slots 428 translates axial displacement to rotation of the sleeve 408 relative to the inner pipe 329. The pawl-and-ratchet mechanism 436 prevents the sleeve 408 from reversing direction as long as the pawl 440 is engaged with one of a set of teeth 448 of a cooperating ratchet gear 444. The axial position of the pawl 440 and the ratchet gear 444 may be configured such that they are in axial register when the cam ball 420 is in the region of the above-discussed joints between the respective J-slots 428, but that they are out of register when the pressure difference is greater than the upper threshold of the intermediate pressure range (e.g., greater than 750 psi).

A default position for the full 420 may typically be at the blind end of the first low-pressure slot 428*a*'. When the cam ball 420 moves, for example, axially along the low-pressure slot 428*a*' towards the successive intermediate slot 428*b*", the cam ball 420 is prevented from entering the previous intermediate slot 428*a*" due to operation of the pawl-and-ratchet mechanism 436, but instead passes the intersection with the previous intermediate slot 428*a*", to enter the successive intermediate slot 428*b*".

The cam track 424 further comprises an automatic reset complement in the example form of a reset recess 452 at an uphole end of the intermediate slots 428". Unlike the slots 428, the reset recess 452 permits rotation of the sleeve 408 relative to the inner pipe 329 under the urging of the torsion spring 456 (when, of course, the cam ball 420 is located in the reset recess 452), until the cam ball 420 bears against a sidewall 460 of the reset recess 452, thereafter being in circumferential alignment with a first intermediate slot 428*a*". Note that the axial positions of the pawl 440 and the ratchet gear 444 are selected such that they are axially out of register when the cam ball 420 is in the reset recess 452, so that the ball 420 is disengaged from the ratchet gear 444 to allow rotation of the sleeve 408 back to its reset position under the bias of the torsion spring 456.

The cam track 424 further comprises an activation slot 468 that is connected end-to-end to a terminal slot 428*f*, the activation slot 468 extending axially beyond the uphole ends of the intermediate slots 428" and into axial register with at least a part of the reset recess 452.

The sleeve 408 is configured such that, when the cam ball 420 is in the activation slot 468, the actuating finger 416 is circumferentially aligned with the trigger finger 416. Movement of the cam ball 420 along the activation slot 468 into a terminal portion thereof corresponding to the reset recess 452 results in engagement of the actuating finger 412 with the trigger finger 416, thereby selectively activating the reamer 144. The control mechanism is therefore in a primed condition when the cam ball 420 is in the terminal low-pressure slot 428*f*", since ramping up of the pressure difference above the upper threshold of the intermediate pressure range (e.g., 750 psi) will then result in deployment of the reamer 144. Premature application of such an above-threshold pressure results in movement of the cam ball 420 to the reset area 452.

The cam track 424 further comprises a reset slot 472 that joins the activation slot 468 with the reset recess 452, and with the terminal slot 428*f*. The cam ball 420 can thus be moved from the activation slot 468 to the reset recess 452 by lowering of the pressure differential within the intermediate pressure range, allowing movement of the cam ball 420 axially uphole along the activation slot 468 and into the reset slot 472 via an angled return slot 476. Subsequent ramping up of the pressure differential results in movement of the cam ball 420 along the reset slot 472 and into the reset recess 452. In contrast, lowering of the pressure differential below the lower threshold of intermediate pressure range (e.g., 250 psi) results in movement of the cam ball 420 back into the terminal slot 428*f*, so that the control mechanism is again in the primed condition, allowing repeated deployment and retraction of the reamer 144 without requiring the performance of the trigger sequence of pressure values between successive deployments.

In operation, the cam ball 420 starts at a position corresponding to no pressure differential, being located at an uphole end of the first low-pressure slot 428*a*'.

When the differential pressure is raised under operator control, the composite piston 312 is axially displaced in the downhole direction under hydraulic actuation due to the pressure differential between the bore-pressure chamber 341 and the annulus-pressure chamber 349, causing axial displacement of the mandrel 315 and therefore of the sleeve 408, so that the cam ball 420 moves along the first low-pressure slot 428*a*' towards its intersection with the successive intermediate slot 428*b*".

If the pressure differential is lowered before the ball 420 enters the successive intermediate slot 428*b*", the ball 420 moves axially uphole back towards its starting position.

At a lower threshold of a predetermined intermediate pressure range (in this example embodiment being 250 psi), the cam ball 420 enters intermediate slot 428*b*". When the bore-annulus pressure difference is in the intermediate pressure range, the first-stage piston 318 is shouldered out against the stop shoulder 355 (FIG. 3B) so that the operative differential area of the staged piston 312 on which the pressure differential acts in order to actuate the sleeve 408 is reduced (corresponding to the reduced annular width w'). In the intermediate pressure range, the sleeve 408 displaced from its initial position, but is stationary, so that the cam ball 420 is stalled at an intermediate position (indicated by reference numeral 464 in FIG. 6).

If the pressure differential is raised above the upper threshold of intermediate pressure range (e.g., above about 750 psi) when the ball 420 is in the intermediate slot 428*b*", the ball 420 moves downhole along the intermediate slot 428" and into the reset recess 452. In such a case, the cam ball 420 is disengaged from any of the rotation-restricting slots 428, and the pawl 440 is disengaged from the ratchet gear 444, so that the torsion spring 456 rotates the sleeve 408 back to its starting position in which the cam ball 420 bears against the sidewall 460 of the reset recess 452.

Lowering of the pressure differential subsequent to entry of the ball 420 into the reset recess 452 causes movement of the cam ball 420 uphole along the first intermediate slot 428*a*", and, if the pressure differential falls below 250 psi, back into the first low-pressure slot 428*a*'. Note that such uphole movement of the cam ball 420 is due to axial displacement of the second-stage piston 321 (corresponding to the intermediate slot 428") or of the composite piston 312 (corresponding to the low-pressure slot 428') under the urging of the compression spring 324 (FIG. 3A).

If, however, the pressure differential is lowered below 250 psi when the cam ball 420 is in the second intermediate slot 428*b*", the cam ball 420 moves downhole into the second low-pressure slot 428*b*', rotating the sleeve 408 relative to the inner pipe 329.

A trigger sequence comprising five consecutive applications of pressure in the range of 250-750 psi, interspersed with reduction of the pressure differential below 250 psi will thus move the cam ball 420 from one slot to the other, and into the terminal low-pressure slot 428*f*, in which the sleeve 408 is in the primed condition. If the pressure differential is thereafter ramped up, the cam ball 420 moves downhole into the activation slot 468, rotating the sleeve 408 so that the actuating finger 412 is circumferentially aligned with the trigger finger 416. When the pressure differential exceeds 750 psi, the sleeve is displaced yet further downhole, so that the actuating finger 412 pushes the trigger finger 416 into an activated position, causing deployment of the reamer arms 208.

The shape and arrangement of the cam track 424 thus defines the pressure sequence that is required to activate the reamer 144. If, in this example, the pressure differential rises above the upper threshold of the intermediate pressure range (e.g., 750 psi) at any stage before the sleeve 408 has been fully rotated into the primed condition, the cam ball 420 moves into the reset recess 452 and is returned to its starting position, so that the trigger sequence has to be restarted if the reamer 144 is to be deployed.

A decrease in the pressure differential after reamer activation results in movement of the cam ball 420 downhole along the activation slot 468 and into the reset slot 472 via the angled return slot 476. If the pressure differential is thereafter reduced below 250 psi, the cam ball 420 moves back into the terminal low-pressure slot 428*f*, whereafter the reamer 144 can again be deployed responsive to application of a pressure differential exceeding 750 psi. In this manner, the control mechanism can be operated in a repeat mode.

If, however, the operator wishes to switch the controller 148 to a reset mode, in which application of the trigger sequence is required to activate the reamer 144 again, a reset sequence may be performed, in this example comprising lowering the pressure differential into the intermediate pressure range, so that the cam ball 420 enters the reset slot 472, and thereafter, without lowering the pressure differential below the lower limit of the intermediate pressure range, raising the pressure differential above the upper limit of the intermediate pressure range (e.g., above 750 psi), causing the cam ball 420 to move downhole along the reset slot 472 and into the reset recess 452. The sleeve 408 in such a case rotates clockwise under the urging of the torsion spring 456 back towards its starting position in which the cam ball 420 bears against the sidewall 460 of the reset recess 452.

In other embodiments, a second ratchet mechanism may be provided to effect a deactivation of the reamer arms 208 responsive to application of defined deactivation pressure sequence.

Note that different reamer activation mechanisms may be employed in other embodiments. The activation mechanism of the reamer 144 may, for example, be hydraulically operated. In one example embodiment, the carriage member (e.g., the sleeve 408) may have an activation component in the form of a valve opening that is to be brought into register with a valve port by axial and angular displacement of the sleeve 408, to expose the hydraulically actuated deployment mechanism to pressure in the bore 128, and thereby to effect deployment of the reamer arms 208.

It is a benefit of the above-described example reamer activation mechanisms that it allows for multiple reamer activation and deactivation cycles that are remotely controllable by control of drilling fluid pressures. Such a mechanism saves a great time, when compared, for example, to ball-drop mechanisms. Selective, repeatable reamer deployment and retraction allows deployment of the reamer only when it is required.

A further benefit of the example systems and methods is that it permits design of a trigger sequence which is unlikely to be performed inadvertently, so that the likelihood of inadvertent deployment of the reamer arms 208 is limited.

The described example embodiments therefore disclose, inter alia, a well tool apparatus to control activation of a drill string tool in a drill string which will extend longitudinally along a borehole to convey drilling fluid under pressure along an internal bore, so that there will be a pressure difference between drilling fluid in the bore and drilling fluid in a borehole annulus defined between the drill string and a borehole wall. The apparatus may comprise a generally tubular housing configured to form an in-line part of the drill string, and a control mechanism mounted in the housing, the control mechanism being configured to effect switching of the drill string tool from an inactive condition to an active condition responsive exclusively to performance of a predefined trigger sequence of variations in the bore-annulus pressure difference. The control mechanism may be configured such that the trigger sequence comprises multiple cycles of raising the bore-annulus pressure difference into, but not above, a predefined intermediate pressure range, and lowering the bore-annulus pressure difference below a lower threshold of the intermediate pressure range.

The control mechanism may further be configured to reset the trigger sequence responsive to raising of the bore-annulus pressure difference above an upper threshold of the intermediate pressure range before a predetermined number of the trigger sequence cycles have been performed. In some example embodiments, the lower threshold of the intermediate pressure range may be between 150 and 250 psi, while the upper threshold of intermediate pressure range may be between 650 and 850 psi.

The control mechanism may further comprise an activation component that is axially displaceable along an interior of the body, the activation component being configured to effect switching of the drill string tool to the active condition responsive at least in part to axial movement of the activation component to an activation position. An biasing mechanism may be operatively coupled to the activation component to urge the activation component axially away from its activation position and towards a default position. In such a case, the control mechanism may further comprise a staged hydraulic actuation mechanism that is configured to actuate axial displacement of the activation component from its default position to an intermediate position responsive to bore-annulus pressure differences within the intermediate pressure range, against operation of the biasing mechanism, and to keep the activation component substantially stationary in its intermediate position while the bore-annulus pressure difference is within the intermediate pressure range, the hydraulic actuation mechanism further being configured to actuate axial displacement of the activation component from the intermediate position to the activation position, against operation of the biasing mechanism, responsive to bore-annulus pressure differences greater than an upper threshold of the intermediate pressure range.

The activation component may be angular displaceable relative to the body (see, e.g., the activation, opponent in the example form of a trigger finger 412, which is a rotatable with the example carriage member that is provided by the tubular sleeve 408), the control mechanism further comprising a rotation mechanism that is configured to displace the activation component angularly from an unprimed condition in which the activation component is angularly misaligned with a trigger component of a tool activation mechanism, to a primed condition in which the activation component is angularly aligned with the trigger component, responsive to performance of the predefined trigger sequence.

The control mechanism may further comprise a carriage member that carries the activation component for axial and rotational displacement with the carriage member relative to the body, the carriage member being operationally connected for axial actuation by the staged hydraulic actuation mechanism. The control mechanism, may also comprise a rotational bias mechanism configured to apply a rotational bias to the carriage member that urges the carriage member rotationally towards an initial unprimed condition and away from a primed condition in which the activation component is angularly aligned with a trigger component of a tool activation mechanism.

In such a case, a cam mechanism may operatively be connected to the carriage member and may be configured to translate reciprocating axial displacement of the carriage member responsive to performance of the trigger sequence to staged rotation of the carriage member from the initial unprimed condition to the primed condition. The cam mechanism may further be configured to resist rotation of the carriage member under the bias of the rotational bias mechanism while the fluid pressure differential is lower than the upper threshold of the intermediate pressure range.

The cam mechanism may comprise an automatic reset component that is configured to permit automatic rotation of the carriage member to the initial unprimed condition under the bias of the rotational bias mechanism responsive to actuated axial displacement of the carriage member past an axial position corresponding to an upper threshold of the intermediate pressure range before the carriage member is rotated to the primed condition. The cam mechanism may further comprise a nonreturn component to resist rotation of the carriage member under the bias of the rotational bias mechanism responsive to raising of the bore-annulus pressure difference above the upper threshold of the intermediate pressure range when the carriage member is in the primed condition. In the example embodiment of FIG. 6, the nonreturn component is provided by the activation slot 468, which rotationally keys the sleeve 408 to the inner pipe 329.

The control mechanism may be configured to be operable, upon switching the drill string tool to the inactive condition subsequent to switching the drill string tool to the active condition, between a repeat mode in which the drill string tool is again switched to the active condition upon raising of the bore-annulus pressure difference above the upper threshold of the intermediate pressure range, without performance of the trigger sequence and a reset mode in which again switching the drill string tool to the active condition is conditional on performance of the trigger sequence.

The described embodiments further disclose, inter alia, a assembly to form part of the drill string and comprises the control mechanism, a drilling installation that comprises the control mechanism, and a method of controlling a drill string tool coupled in a drill string.

One aspect of the disclosure, as exemplified by the above-described example embodiments, thus comprises a drill string tool configured for use in a drill string within a borehole, wherein the drill string will define an internal bore and a borehole annulus, the drill string tool comprising a housing configured to form an in-line part of the drill string; and a control mechanism mounted in the housing, the control mechanism configured to switch the drill string tool from an inactive condition to an active condition in response to a predefined trigger sequence of variations between pressure in the internal bore relative to pressure in the borehole annulus, wherein the trigger sequence comprises multiple cycles of, at least, (a) raising the fluid pressure differential into, but not above, a predefined intermediate pressure range, and (b) lowering the fluid pressure differential below a lower threshold of the intermediate pressure range.

The control mechanism may further be configured to reset the trigger sequence in response to raising of the fluid pressure differential above an upper threshold of the intermediate pressure range before a predetermined number of the trigger sequence cycles have been performed.

The lower threshold of the intermediate pressure range may be between 150 and 250 psi, while the upper threshold of the intermediate pressure range may be between 650 and 850 psi.

The control mechanism may further comprise an activation component that is axially displaceable along an interior of the body, the activation component being configured to effect switching of the drill string tool to the active condition responsive at least in part to axial movement of the activation component to an activation position. In such a case, the control mechanism may also comprise a biasing mechanism operatively coupled to the activation component and configured to urge the activation component axially away from its activation position and towards a default position. In addition, the drill string tool may comprise a staged hydraulic actuation mechanism configured to cause axial displacement of the activation component from its default position to an intermediate position in response to fluid pressure differentials within the intermediate pressure range, against operation of the biasing mechanism, and to keep the activation component substantially stationary in its intermediate position while the pressure differential is within the intermediate pressure range, the hydraulic actuation mechanism further configured to cause axial displacement of the activation component from the intermediate position to the activation position, against operation of the biasing mechanism, in response to the fluid pressure differential being greater than the upper threshold of the intermediate pressure range.

The activation component may be angularly displaceable relative to the body, the control mechanism further comprising a rotation mechanism configured to displace the activation component angularly from an unprimed condition in which the activation component is angularly misaligned with a trigger component of a tool activation mechanism, to a primed condition in which the activation component is angularly aligned with the trigger component, responsive to performance of the predefined trigger sequence.

The control mechanism may further comprise a carriage member carrying the activation component for axial and rotational displacement with the carriage member relative to the body, the carriage member configured for axial displacement caused by the staged hydraulic actuation mechanism. A rotational bias mechanism may be provided in combination with the carriage member, the rotational bias mechanism being configured to apply a rotational bias to the carriage member, to urge the carriage member rotationally towards an initial unprimed condition and away from a primed condition in which the activation component is angularly aligned with a trigger component of a tool activation mechanism.

A cam mechanism may be operatively connected to the carriage member and may be configured (a) to translate reciprocating axial displacement of the carriage member responsive to performance of the predefined trigger sequence to staged rotation of the carriage member from the initial unprimed condition to the primed condition, and (b) to resist rotation of the carriage member under the bias of the rotational bias mechanism while the fluid pressure differential is lower than the upper threshold of the intermediate pressure range.

The cam mechanism may comprise an automatic reset component configured automatically to permit rotation of the carriage member to the initial unprimed condition under the bias of the rotational bias mechanism responsive to actuated axial displacement of the carriage member past an axial position corresponding to an upper threshold of the intermediate pressure range before the carriage member is rotated to the primed condition. The cam mechanism may further comprise a non-return component to resist rotation of the carriage member under the bias of the rotational bias mechanism responsive to raising of the fluid pressure differential above the upper threshold of the intermediate pressure range when the carriage member is in the primed condition. The control mechanism may be configured to be operable, upon switching the drill string tool to the inactive condition subsequent to switching the drill string tool to the active condition, between, on the one hand, a repeat mode in which the drill string tool is again switched to the active condition upon raising of the fluid pressure differential above the upper threshold of the intermediate pressure range, without performance of the predefined trigger sequence, and, on the other hand a reset mode in which again switching the drill string tool to the active condition is conditional on performance of the predefined trigger sequence.

Another aspect of the disclosure comprises a reamer assembly to form part of a drill string within a borehole, wherein the drill string will define an internal bore and a borehole annulus, the reamer assembly comprising: a generally tubular housing configured to form an in-line part of the drill string; one or more reamer cutting elements mounted on the reamer housing and being disposable between an active condition in which the one or more cutting elements project radially outwards from the housing to ream the borehole, and an inactive condition in which the one or more reamer cutting elements are retracted; and a control mechanism mounted in the housing, the control mechanism configured to switch the drill string tool from the inactive condition to the active condition in response to a predefined trigger sequence of variations between pressure in the internal bore relative to pressure in the borehole annulus, the control mechanism configured to prevent switching of the drill string tool to the active condition via the control mechanism without the trigger sequence, wherein the trigger sequence comprises multiple cycles of raising the fluid pressure differential into a predefined intermediate pressure range, and lowering the fluid pressure differential below a lower threshold of the intermediate pressure range.

A further aspect of the disclosure comprises a drilling installation including:

an elongated drill string extending longitudinally along a borehole, the drill string having a housing that defines a longitudinally extending bore and a borehole annulus;

a drill string tool forming part of the drill string and configured to be disposable between an active condition and an inactive condition;

a control mechanism configured to allow switching of the drill string tool from the active condition to the inactive condition only if a predefined trigger sequence of changes in an internal bore-borehole annulus is experienced at the control mechanism, wherein the trigger sequence comprises raising the internal bore-borehole annulus pressure differential above a lower threshold of a predetermined intermediate pressure range, but not above an upper threshold of the intermediate pressure range, and lowering the internal bore-borehole annulus pressure differential below the lower threshold of the intermediate pressure range.

A further aspect discloses a method of controlling a drill string tool coupled in a drill string within a borehole, the drill string defining an internal bore and a borehole annulus, the method comprising:

applying a predefined trigger sequence of internal bore-borehole annulus pressure differential variations, to control switching of the drill string tool from an inactive condition to an active condition, the trigger sequence comprising raising the internal bore-borehole annulus pressure differential above a lower threshold of a predetermined intermediate pressure range, but not above an upper threshold of the intermediate pressure range, and lowering the internal bore-borehole annulus pressure differential below the lower threshold of the intermediate pressure range, wherein the drill string comprises a control mechanism mounted in the housing and configured to automatically switch the drill string tool from the active condition to the inactive condition in response to application of the pressure differential trigger sequence.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus comprising:

a body configured for incorporation in a drill string to convey drilling fluid along an interior of the body;

a control mechanism connected to the body and configured for coupling to a drill string tool to switch the drill string tool from an inactive condition to an active condition in response to occurrence of a predefined trigger sequence in variations in a fluid pressure differential between the interior and an exterior of the body, the predefined trigger sequence comprising multiple cycles of increasing the fluid pressure differential into, but not above, a predefined intermediate pressure range, and subsequently lowering the predefined trigger sequence below the predefined intermediate pressure range;

wherein the control mechanism is further configured to be disposed between:

a repeat mode in which the drill string tool is again switched to the active condition upon raising of the fluid pressure differential above the predefined intermediate pressure range, without performance of the predefined trigger sequence; and a reset mode in which again switching the drill string tool to the active condition is conditional on performance of the predefined trigger sequence.

2. The apparatus of claim 1, wherein a lower threshold of the predefined intermediate pressure range is between 150 and 250 psi.

3. The apparatus of claim 2, wherein an upper threshold of the predefined intermediate pressure range is between 650 and 850 psi.

4. The apparatus of claim 1, wherein the control mechanism further comprises:

an activation component that is axially displaceable along the interior of the body, the activation component being configured to effect switching of the drill string tool to the active condition responsive at least in part to axial movement of the activation component to an activation position;

a biasing mechanism operatively coupled to the activation component and configured to urge the activation component axially away from its activation position and towards a default position; and a staged hydraulic actuation mechanism configured to cause axial displacement of the activation component from its default position to an intermediate position, against operation of the biasing mechanism, in response to the fluid pressure differential being within the predefined intermediate pressure range, and to keep the activation component substantially stationary in the intermediate position while the pressure differential is within the predefined intermediate pressure range, the hydraulic actuation mechanism further configured to cause axial displacement of the activation component from the intermediate position to the activation position, against operation of the biasing mechanism, in response to the fluid pressure differential being greater than the predefined intermediate pressure range.

5. The apparatus of claim 4, wherein the activation component is angularly displaceable relative to the body, the control mechanism further comprising a rotation mechanism configured to displace the activation component angularly from an unprimed condition in which the activation component is angularly misaligned with a trigger component of a tool activation mechanism, to a primed condition in which the activation component is angularly aligned with the trigger component, responsive to performance of the predefined trigger sequence.

6. The apparatus of claim 5, wherein the control mechanism further comprises:

a carriage member carrying the activation component for axial and rotational displacement with the carriage member relative to the body, the carriage member configured for axial displacement caused by the staged hydraulic actuation mechanism;

a rotational bias mechanism configured to apply a rotational bias to the carriage member, to urge the carriage member rotationally towards an initial unprimed condition and away from a primed condition in which the activation component is angularly aligned with a trigger component of a tool activation mechanism;

a cam mechanism operatively connected to the carriage member and configured to translate reciprocating axial displacement of the carriage member responsive to performance of the predefined trigger sequence to staged rotation of the carriage member from the initial unprimed condition to the primed condition, and to resist rotation of the carriage member under the bias of the rotational bias mechanism while the fluid pressure differential is lower than the predefined intermediate pressure range.

7. The apparatus of claim 6, wherein the cam mechanism comprises:

an automatic reset component configured automatically to permit rotation of the carriage member to the initial unprimed condition under the bias of the rotational bias mechanism responsive to actuated axial displacement of the carriage member past an axial position corresponding to an upper threshold of the predefined intermediate pressure range before the carriage member is rotated to the primed condition, and a non-return component to resist rotation of the carriage member under the bias of the rotational bias mechanism responsive to raising of the fluid pressure differential above the predefined intermediate pressure range when the carriage member is in the primed condition.

8. A drill tool assembly comprising:

a generally tubular body configured for incorporation in a drill string to convey drilling fluid along an interior of the body;

a drill string tool mounted on the body and being disposable between an active condition and an inactive condition; and a control mechanism mounted on the body and coupled to the drill string tool, the control mechanism configured to switch the drill string tool from the inactive condition to the active condition in response to occurrence of a predefined trigger sequence in variations in a fluid pressure differential between the interior and an exterior of the body, the predefined trigger sequence comprising multiple cycles of increasing the fluid pressure differential into, but not above, a predefined intermediate pressure range, and subsequently lowering e predefined trigger sequence below the predefined intermediate pressure range;

wherein the control mechanism is further configured to to be disposed between:

a repeat mode in which the drill string tool is in the inactive condition and is returnable to the active condition by raising the fluid pressure differential above the predefined intermediate pressure range, without intermediate performance of the defined trigger sequence; and a reset mode in which the drill string tool is in the inactive condition and return of the drill string tool to the active condition is conditional on performance of the predefined trigger sequence.

9. A drill tool assembly of claim 8, wherein the drill string tool comprises one or more reamer cutting elements mounted on the body and configured for displacement between the active condition, in which the one or more reamer cutting elements project radially outwards from the body for borehole reaming, and the inactive condition in which the one or more reamer cutting elements are retracted.

10. A drilling installation comprising:

an elongated drill string extending longitudinally along a borehole, the drill string having an elongated body having a hollow interior to convey drilling fluid along the drill string;

a drill string tool forming part of the drill string and configured to be disposable between an active condition and an inactive condition;

a control mechanism connected to the body and coupled to the drill string tool to switch the drill string tool from the inactive condition to the active condition in response to occurrence of a predefined trigger sequence in variations in a fluid pressure differential between the interior and an exterior of the body, the predefined trigger sequence comprising multiple cycles of increasing the fluid pressure differential into, but not above, a predefined intermediate pressure range, and subsequently lowering the predefined trigger sequence below the predefined intermediate pressure range;

wherein the control mechanism is further configured to be selectively disposed between:

a repeat mode in which the drill string tool is in the inactive condition and is returnable to the active condition by raising the fluid pressure differential above the predefined intermediate pressure range, without intermediate performance of the predefined trigger sequence; and a reset mode in which the drill string tool is in the inactive condition and return of the drill string tool to the active condition is conditional on performance of the predefined trigger sequence.

11. The drilling installation of claim 10, wherein the predefined trigger sequence comprises a predefined minimum number of the cycles that are to be performed without, at any time after initiation of the predefined trigger sequence, raising the fluid pressure differential above the predefined intermediate pressure range.

12. The drilling installation of claim 11, wherein the control mechanism further comprises:

a carriage member axially displaceable along the body and configured to switch the drill string tool to the active condition responsive at least in part to actuated axial movement of the carriage member to an operational zone subsequent to performance of the predefined trigger sequence;

an axial bias mechanism operatively coupled to the carriage member to urge the carriage member axially away from its operational zone and towards a default position; and a staged hydraulic actuation mechanism configured to cause axial displacement of the carriage member from its default position to an intermediate position, against operation of the axial bias mechanism, in response to the fluid pressure differential being within the predefined intermediate pressure range, and to keep the carriage member substantially stationary in its intermediate position while the pressure differential is within the predefined intermediate pressure range, the hydraulic actuation mechanism further being configured to actuate axial displacement of the carriage member from the intermediate position to the operational zone, against operation of the axial bias mechanism, in response to fluid pressure differentials greater than an upper threshold of the predefined intermediate pressure range.

13. The drilling installation of claim 12, wherein the carriage member is rotatable relative to the body, the control mechanism further comprising:

a rotational bias mechanism coupled to the carriage member and configured to apply a rotational bias to the carriage member; and a cam mechanism operatively coupled to the carriage member and configured to translate reciprocating axial displacement of the carriage member in response to performance of the predefined trigger sequence to step-wise rotation of the carriage member, against the bias of the rotational bias mechanism, from an initial unprimed angular orientation to a primed angular orientation, and to resist reverse rotation of the carriage member under the bias of the rotational bias mechanism during performance of the predefined trigger sequence.

14. The drilling installation of claim 13, wherein the cam mechanism comprises:

an automatic reset component configured automatically to allow rotation of the carriage member to the initial unprimed angular orientation under the bias of the rotational bias mechanism in response to actuated axial displacement of the carriage member past an axial position corresponding to an upper threshold of the predefined intermediate pressure range while the carriage member is not in the primed angular orientation; and a non-return component to resist rotation of the carriage member under the bias of the rotational bias mechanism in response to raising of the fluid pressure differential above the predefined intermediate pressure range when the carriage member is in the primed condition.

15. A method of controlling a drill string tool incorporated in a drill string within a borehole, the drill string having a body defining a hollow interior to convey drilling fluid along the drill string, the method comprising:

applying a predefined trigger sequence in variations in fluid pressure differential between the interior and an exterior of the body, the predefined trigger sequence comprising multiple cycles of increasing the fluid pressure differential into, but not above, a predefined intermediate pressure range, and subsequently lowering the predefined trigger sequence below the predefined intermediate pressure range, wherein the drill string comprises a control mechanism mounted in the body and configured to automatically switch the drill string tool from an active condition to an inactive condition in response to application of the predefined trigger sequence trigger sequence;

interrupting the predefined trigger sequence in response to the pressure differential being raised above the predefined intermediate pressure range before a predefined minimum number of the cycles are completed, so that subsequent performance of at least the minimum number of the cycles are required to switch the drill string tool to the active condition; and performing respective fluid-pressure control sequences to selectively dispose the control mechanism, after activation of the drill string tool, between:

a repeat mode in which the drill string tool is in the inactive condition and is returnable to the active condition by raising the fluid pressure differential above the redefined intermediate pressure range, without intermediate performance of the predefined trigger sequence; and a reset mode in which the drill string tool is in the inactive condition and return of the drill string tool to the active condition is conditional on performance of the predefined trigger sequence.

16. The method of claim 15, wherein applying the predefined trigger sequence comprises performing the predefined minimum number of the cycles without, after starting the predefined trigger sequence, raising the fluid pressure differential above the predefined intermediate pressure range.

17. The method of claim 15, wherein the drill string tool comprises a reamer.

* * * * *